US009980064B2

(12) United States Patent
Mauger et al.

(10) Patent No.: US 9,980,064 B2
(45) Date of Patent: May 22, 2018

(54) SUB-CRANIAL VIBRATORY STIMULATOR

(71) Applicant: Cochlear Limited, Macquarie University, NSW (AU)

(72) Inventors: Stefan Mauger, Macleod (AU); Mark Christopher Flynn, Gotenborg (SE)

(73) Assignee: Cochlear Limited, Macquarie University, NSW (AU)

( * ) Notice: Subject to any disclaimer, the term of this patent is extended or adjusted under 35 U.S.C. 154(b) by 1070 days.

(21) Appl. No.: 14/040,823

(22) Filed: Sep. 30, 2013

(65) Prior Publication Data

US 2015/0094522 A1 Apr. 2, 2015

(51) Int. Cl.
*H04R 25/00* (2006.01)

(52) U.S. Cl.
CPC ..... *H04R 25/606* (2013.01); *H04R 2225/67* (2013.01); *H04R 2460/13* (2013.01)

(58) Field of Classification Search
CPC .... H04R 25/60; H04R 25/604; H04R 25/606; H04R 2460/13; H04R 2225/67
See application file for complete search history.

(56) References Cited

U.S. PATENT DOCUMENTS

| | | | | |
|---|---|---|---|---|
| 7,772,524 | B2 | 5/2010 | Lupin et al. | |
| 2006/0025648 | A1* | 2/2006 | Lupin | H04R 25/606 600/25 |
| 2007/0191673 | A1* | 8/2007 | Ball | H04R 25/606 600/25 |
| 2008/0255406 | A1* | 10/2008 | Ball | H04R 11/02 600/25 |
| 2009/0209806 | A1* | 8/2009 | Hakansson | H04R 25/606 600/25 |
| 2010/0048983 | A1 | 2/2010 | Ball et al. | |
| 2012/0014546 | A1* | 1/2012 | Puria | H04R 25/606 381/320 |

* cited by examiner

*Primary Examiner* — Charles A Marmor, II
*Assistant Examiner* — Carrie R Dorna
(74) *Attorney, Agent, or Firm* — Edell, Shapiro & Finnan, LLC

(57) ABSTRACT

A sub-cranial vibratory stimulator that at least partially bypasses a recipient's skull bone and delivers vibration to fluid within a recipient's skull bone. The sub-cranial vibratory stimulator comprises an actuator that is configured to be implanted beneath a recipient's skull bone. The actuator transfers vibration to the fluid within the recipient's skull without first passing through the skull bone. The actuator is also substantially mechanically decoupled (isolated) from the recipient's skull bone.

24 Claims, 11 Drawing Sheets

SUB-CRANIAL VIBRATORY STIMULATOR

BACKGROUND

Field of the Invention

The present invention relates generally to an implantable stimulator, and more particularly, to a sub-cranial vibratory stimulator.

Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals suffering from conductive hearing loss typically receive an acoustic hearing aid. Hearing aids rely on principles of air conduction to transmit acoustic signals to the cochlea. Typically, a hearing aid is positioned in the ear canal or on the outer ear to amplify received sound. This amplified sound is delivered to the cochlea through the normal middle ear mechanisms resulting in the increased perception of sound by the recipient.

In contrast to acoustic hearing aids, certain types of auditory prostheses, commonly referred to as bone conduction devices, convert a received sound into vibrations. The vibrations are transferred through a recipient's skull bone to the cochlea, causing generation of nerve impulses, which result in the perception of the received sound. Bone conduction devices may be used to treat a variety of types of hearing loss and may be suitable for individuals who cannot derive sufficient benefit from acoustic hearing aids, cochlear implants, etc., or for individuals who suffer from stuttering problems.

SUMMARY

In one aspect of the invention, an apparatus is provided. The apparatus comprises an implantable actuator configured to be implanted between a recipient's skull bone and the recipient's dura mater to vibrate bodily fluid of the recipient and an isolation member formed from a vibration damping material. The isolation member is configured to be positioned between the implantable actuator and the recipient's skull bone and is configured to substantially mechanically decouple the implantable actuator from the recipient's skull bone.

In another aspect of the present invention, a sub-cranial component is provided. The sub-cranial component comprises a body formed from a vibration damping material configured to be implanted between a recipient's skull bone and the recipient's dura mater and an implantable actuator positioned in the body and configured to generate mechanical vibrations for delivery to bodily fluid of the recipient. The body is configured to substantially mechanically decouple the actuator from the recipient's skull bone to substantially prevent mechanical vibrations generated by the implantable actuator from passing through the body to the skull bone.

BRIEF DESCRIPTION OF THE DRAWINGS

Embodiments of the present invention are described herein in conjunction with the accompanying drawings, in which.

DETAILED DESCRIPTION

Bone conduction devices generally operate by converting a received sound into vibrations that are delivered to a recipient's cochlea via a direct or indirect coupling to a recipient's skull bone. For example, percutaneous bone conduction devices are directly coupled to a recipient's skull via a percutaneous abutment that extends from an implantable component. The implantable component is attached to the recipient's skull bone via one or more bone screws and vibration from the bone conduction device passes from the abutment through the implantable component to the skull.

In certain transcutaneous bone conduction devices, an external bone conduction device (or a portion thereof) includes an external magnetic plate that magnetically couples to an implantable component that includes an internal magnetic plate. The implantable component is attached to the recipient's skull bone via one or more bone screws and vibration from the bone conduction device passes from the external magnetic plate to the internal magnetic plate for delivery to the skull. Other transcutaneous bone conduction devices use an implantable component that includes an actuator. The actuator generates vibration that is delivered to the skull directly or via a portion of implantable component.

As such, an aspect of both percutaneous and transcutaneous bone conduction devices is that those devices transfer vibration to a recipient's skull bone for conduction to the cochlea. Embodiments presented herein are directed to a sub-cranial vibratory stimulator that bypasses, or at least partially bypasses, a recipient's skull bone and delivers vibration to fluid within a recipient's skull bone. More specifically, the sub-cranial vibratory stimulator comprises an actuator (transducer) that is configured to be implanted beneath a recipient's skull bone. The actuator transfers vibration to the fluid within the recipient's skull without first passing through the skull bone. The actuator is also substantially mechanically decoupled (isolated) from the recipient's skull bone.

Figure 1A:
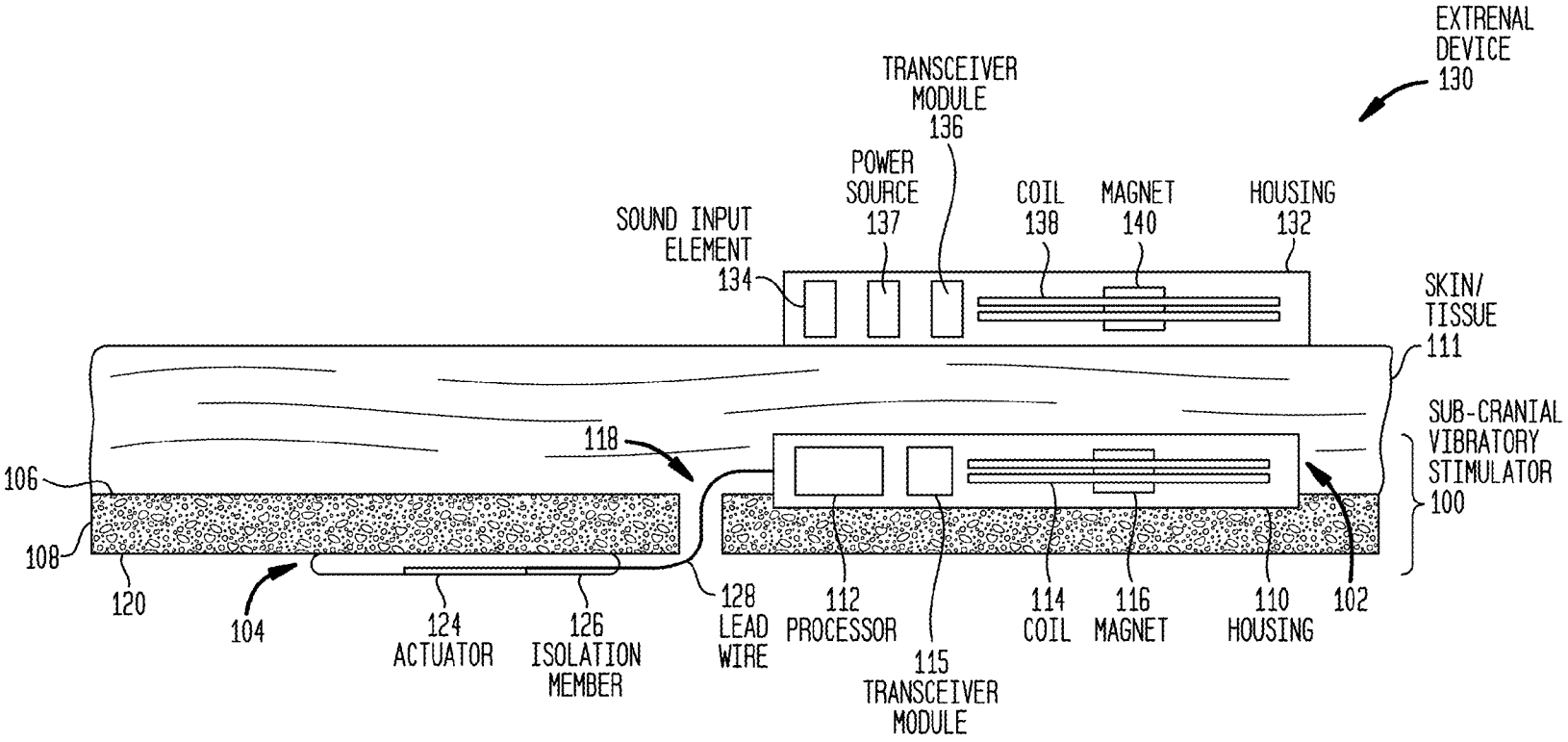
FIG. 1A is a cross-sectional schematic diagram illustrating a sub-cranial vibratory stimulator in accordance with embodiments presented herein.

FIG. 1A is a schematic diagram illustrating a cross-sectional view of a sub-cranial vibratory stimulator 100 in accordance with embodiments presented herein. As shown, the sub-cranial vibratory stimulator 100 comprises an electronics module 102 and a sub-cranial component 104.

The electronics module 102 is configured to be positioned adjacent an outer surface 106 of a recipient's skull bone 108 beneath a recipient's skin/tissue 111. In certain circumstances, the electronics module 102 is positioned in a natural or surgically formed recess of skull bone 108. In the same or other embodiments, the electronics module 102 may be secured to the skull bone 108 via, for example, one or more bone screws, a biocompatible adhesive, etc. The electronics module 102 comprises a housing 110, a processor (e.g., sound processor) 112, an internal coil 114, a transceiver module 115, and a magnet 116 fixed relative to the internal coil 114. The processor 112, internal coil 114, and magnet 116 are positioned in housing 110.

Figure 1B:
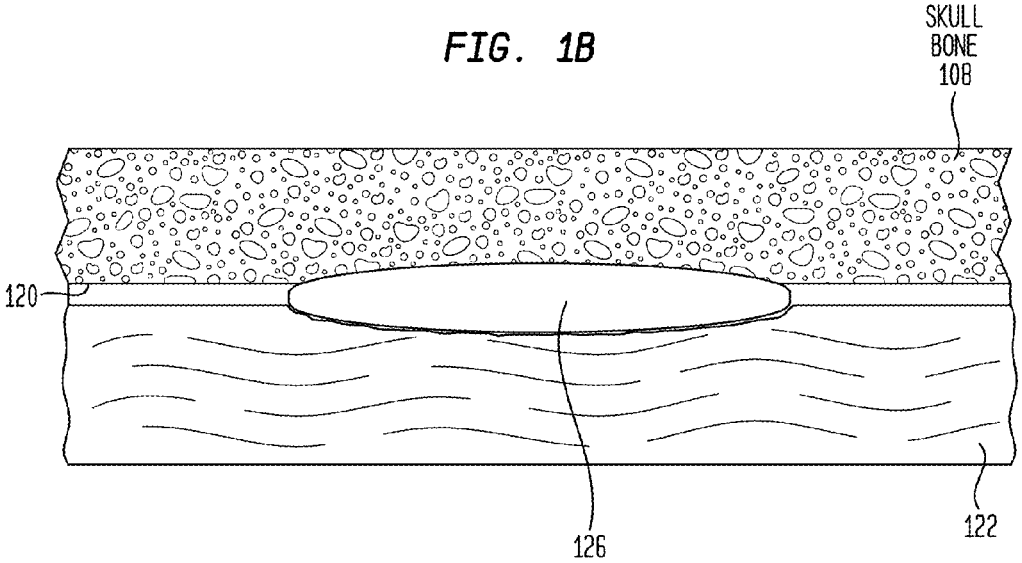
FIG. 1B is a side view of a sub-cranial component of the sub-cranial vibratory stimulator of FIG. 1A.

The sub-cranial component 104 is configured to be inserted through an opening 118 in the recipient's skull 108. Following implantation, the sub-cranial component 104 is positioned adjacent to an inner surface 120 of the skull bone 108 between the skull bone and the recipient's dura mater 122 (FIG. 1B) that lies in close proximity to the skull bone 108. As such, the sub-cranial component 104 is configured to be retained in an implanted position (i.e., a position selected by a surgeon) via a compression force applied by the dura mater 122. That is, the sub-cranial component 104 is retained (held) in the implanted position without the addition of fixation elements such as bone screws. In the illustrated configuration the sub-cranial component is positioned on the underside of the recipient's skull bone 108 adjacent to the dura mater 122. For ease of illustration the recipient's dura mater 122 has been omitted from FIG. 1A.

As shown in FIG. 1A, the sub-cranial component 104 comprises an actuator (transducer) 124 and a body 126. As described further below, the body 126 is formed from a vibration damping material that substantially mechanically decouples (i.e., isolates) the actuator 124 from the recipient's skull bone 108. As such, body 126 is sometimes referred to herein as an isolation member 126. The actuator 124 is electrically connected to the processor 112 in outer component 102 via a lead wire 128.

In the embodiment of FIG. 1A, the sub-cranial vibratory stimulator 100 operates with an external device 130. The external device 130 comprises a housing 132 and sound input element 134. The sound input element 134 may be, for example, a microphone, telecoil or similar device configured to receive (detect) sounds. In the present example, sound input element 134 is located in housing 132, but may alternatively be positioned on housing 132, on a cable extending from the housing 132, positioned in a recipient's ear, subcutaneously implanted in the recipient, etc. Sound input element 134 may also be a component that receives an electronic signal indicative of sound, such as, for example, from an external audio device. For example, sound input element 134 may receive a sound signal in the form of an electrical signal from a device electronically connected to sound input element 134. Additionally, multiple sound input elements 134 may be provided.

Positioned in the housing 132 are a transceiver module 136, power source (battery) 137, external coil 138, and magnet 140. The magnet 140 is fixed relative to the external coil 138 and is configured to magnetically couple to the magnet 116 in electronics module 102. The coils 138 and 114 form a transcutaneous link that enables the electronics module 102 to receive signals from, or transmit signals to, the external device 130. The magnets 140 and 116 facilitate the operational alignment of the coils 138 and 114. In certain examples, external coil 138 transmits electrical signals (e.g., power and stimulation data) to internal coil 114 via a radio frequency (RF) link. It is to be appreciated that various types of energy transfer, such as infrared (IR), electromagnetic, capacitive and inductive transfer, may alternatively or additionally be used to transfer the power and/or data from external device to electronics module 102.

In operation, sound input element 134 converts received sound signals into electrical signals or receives electrical signals representative of sound. These electrical signals are transferred to electronics module 102 via the coils 138 and 114. The processor 112 processes the electrical signals to generate control signals that cause the actuator 124 to generate vibration. In other words, the actuator 124 converts electrical control signals received from the processor 112 (via lead wire 128) into mechanical vibrations.

It is to be appreciated that the external device 130 may take a number of different arrangements. In certain embodiments, the external device 130 may be a Behind-The-Ear device. In other embodiments, the external device 130 may be a button processor, a body worn processors, etc.

In certain embodiments, the sub-cranial vibratory stimulator 100 may be a totally implantable device. As such, elements of the external device 130 (e.g., sound input element, battery, etc.) may be incorporated in, for example, the electronics module 102

As noted above, the isolation member (body) 126 is configured to mechanically decouple the actuator 124 from the recipient's skull bone 108. More specifically, when the actuator 124 generates mechanical vibrations, the isolation member 126 is configured to substantially prevent those vibrations from passing through the isolation member 126 to the recipient's skull bone 108. Isolation member 126 is formed from a vibration damping material such as silicon.

It is to be appreciated that a range of possible materials other than silicone could be used to form the isolation member 126. Other materials include, but are not limited to, polyurethane, polyester, polyphenylsulfone (PPSU), polyether ether ketone (PEEK), epoxy. Metals such as platinum, platinum/iridium, tungsten and titanium may be incorporated into, or form part of, the isolation member 126. Also layers of these materials or composites of these materials may also be used. Multiple materials may be used to obtain damping characteristics from both materials, or create a specific damping characteristic. This could be used to target the damping to a specific frequency range that causes feedback.

As shown in FIG. 1A, actuator 124 is positioned at a bottom surface (i.e., a surface facing the recipient's dura matter) of the isolation member 126. This positioning of the actuator 124, coupled with the mechanical properties of the isolation member 126, generally causes the mechanical vibration generated by the actuator to be directed to the dura mater 122 (FIG. 1B) and the bodily fluid (e.g., cerebrospinal fluid (CSF)) within the recipient's skull and not to the recipient's skull bone 108. The substantial mechanical isolation of the actuator 124 from the recipient's skull bone 108 substantially eliminates feedback (noise) within the device. As such, isolation member 126 is sometimes referred to herein as a feedback isolation member.

A typical bone conduction may be suitable for recipients with a conductive hearing loss of up to 55-65 dB HL. A vibratory stimulator in accordance with embodiments presented herein could be used to provide hearing rehabilitation to recipient's with a greater degree of hearing loss. For instance, a vibratory stimulator could be used for recipients with a conductive hearing loss of up to 55-75 dB HL.

The sub-cranial vibratory stimulator 100 uses only mechanical vibration to compensate for hearing loss and no additional stimulation component, such as an implanted electrode array, middle ear implant, etc. is utilized. Additionally, the coils 128 and 114 and the processor 112 may be designed to only support vibratory stimulation.

As noted, bone conduction devices operate to transfer mechanical vibrations to a recipient's skull bone. However, mechanical vibration passing through a recipient's skull bone may experience mechanical losses. As such, bone conduction devices generally generate the mechanical vibrations with sufficient magnitude that compensates for the losses that occur within the skull bone. The generation of higher magnitude vibrations that compensate for bone losses requires the use of higher power actuators within bone conduction devices. In one specific example, an actuator of a bone conduction device has power requirements of approximately 1.45 milliwatts (mW) (while operating in a quiet environment) to 8.12 mW (while operating in a noisy environment).

Also as noted above, a sub-cranial vibratory stimulator in accordance with embodiments presented herein is configured to at least partially bypass the skull bone and deliver vibration to bodily fluid (e.g., CSF) within a recipient's skull directly or via the recipient's dura mater. In contrast to the skull bone, mechanical vibrations passing through bodily fluid generally experience minimal losses (i.e., bodily fluid is a substantially loss-less conductor of mechanical vibrations). As such, sub-cranial vibratory stimulators in accordance with embodiments presented herein have a more direct pathway to the middle/inner ear and may use lower power actuators (relative to those used in bone conduction devices) because there is no longer a need to compensate for vibration losses introduced by the skull bone.

For example, in accordance with certain embodiments presented herein, a sub-cranial vibratory stimulator, such as sub-cranial vibratory stimulator 100, may include a low-power actuator 124. In one specific example, a low-power actuator 124 has power requirements of approximately 0.1 mW. In other examples, a low-power actuator 124 has power requirements of less than approximately 1 mW. In certain embodiments, the low-power actuator 124 is a piezoelectric actuator/transducer made from a range of materials including ceramics, crystals and nano-materials. The low-power actuator 124 could also be an electromagnetic transducer, such as a balanced armature transducer or a range of rotational transducers, or a floating mass transducer. In accordance with embodiments presented herein, the transducer is, or includes elements that are, configured to deform in shape to generate vibrations within the recipient's bodily fluid.

FIG. 1A illustrates a specific implementation where the sound input element 134 is positioned in the external device 130 and the processor 112 is positioned in the implanted electronics module 102. It is to be appreciated that other embodiments/arrangements are possible. For example, in one alternative embodiment, the processor 112 may be positioned in the external device 130. In such embodiments, the actuator control signals are transcutaneously transferred from the external device 130 to the electronics module 102 for delivery to the actuator 124. In other embodiments, the sub-cranial vibratory stimulator 100 may be a fully implantable device that includes an implantable sound input element (e.g., microphone) and an implantable re-chargeable power source. In the case of a totally implantable device, the sub-cranial vibratory stimulator 100 may be advantageous not because it can address a larger range of hearing loss, but because it may just address the same hearing loss as a conventional device with less power usage.

In certain embodiments, the coils 128 and 114 and the processor 112 may be designed to only support vibratory stimulation (i.e., not designed for electrical stimulation). The use of vibratory-specific coils and/or a processor may reduce power requirements, simplify operation, and/or reduce costs.

FIG. 1A also illustrates the electronics module 102 positioned at an outer surface 106 of the recipient's skull bone 108. In further embodiments, the electronics module 102 may be configured to be implanted beneath the recipient's skull (i.e., in a sub-cranial position).

A sub-cranial component of a sub-cranial vibratory may have different positions underneath a recipient's skull. For example, FIG. 1A illustrates an example where the sub-cranial component 104 is offset from the opening 118 through which the sub-cranial component 104 is inserted. In an alternative embodiment, the sub-cranial component 104 is at least partially positioned beneath the opening 118.

Figure 2A:
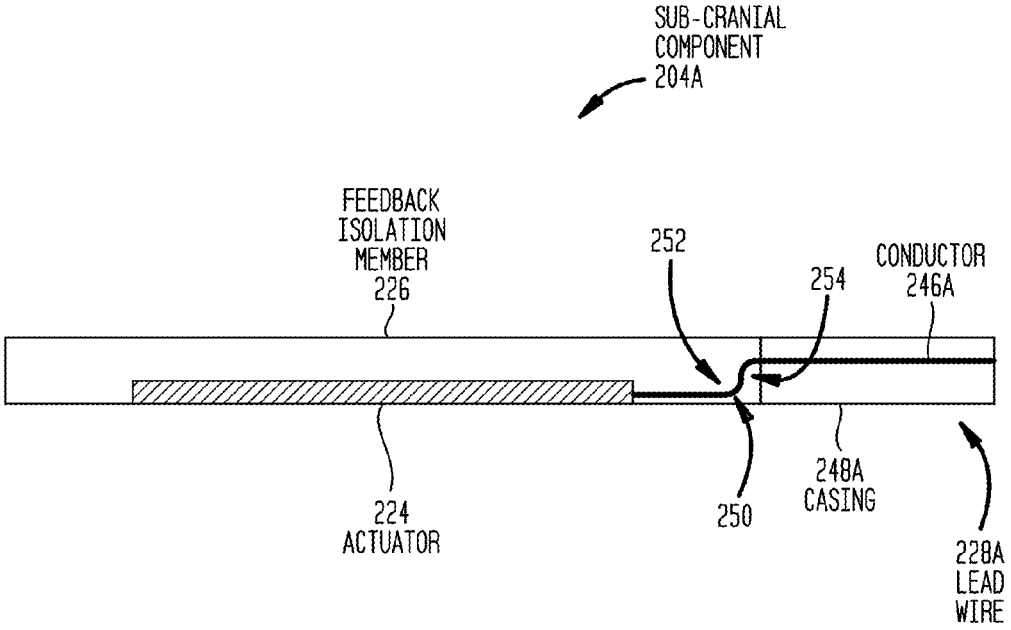
FIG. 2A is a cross-sectional view of a sub-cranial component in accordance with embodiments presented herein.
Figure 2B:
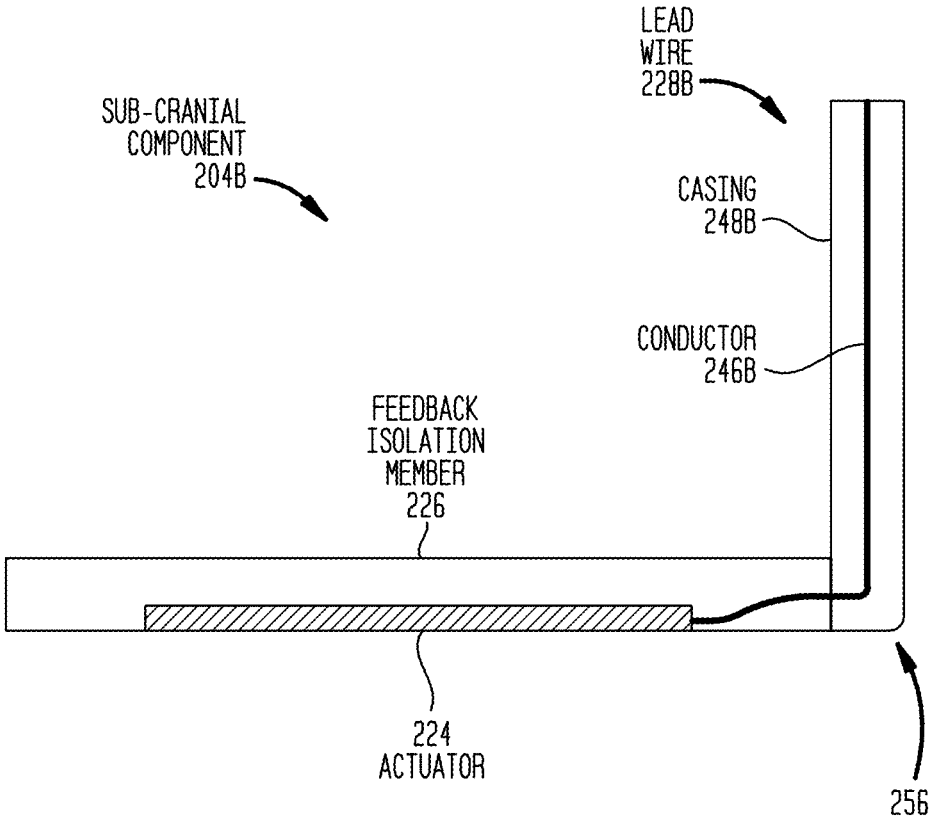
FIG. 2B is a cross-sectional view of another sub-cranial component in accordance with embodiments presented herein.

In certain embodiments, the lead wire and connection to the actuator facilitate the positioning of a sub-cranial component in a particular sub-cranial position. FIGS. 2A and 2B illustrate specific arrangements of a lead wire connecting a sub-cranial component to an electronics module (not shown).

In the embodiment of FIG. 2A, the lead wire 228A comprises a conductor 246A and an electrically insulating casing 248A. The sub-cranial component 204A comprises an actuator 224 and an isolation member 226. The sub-cranial component 204A is configured to be offset from an opening in a recipient's skull. To facilitate the offset positioning of the sub-cranial component 204A, the conductor 246A comprises a transition region 250 that connects two offset segments (portions) of the conductor. The transition region 250 has a generally zigzag or sinuous shape.

More specifically, the transition region 250 comprises a first angle 252 and a second angle 254. The first and second angles 252 and 254 face in substantially opposing directions forming the zigzag shape of the transition region 250.

In the embodiment of FIG. 2B, the lead wire 228B comprises a conductor 246B and an electrically insulating casing 248B. The sub-cranial component 204B comprises an actuator 224 and an isolation member 226. The sub-cranial component 204A is configured to be at least partially positioned underneath an opening in a recipient's skull. To facilitate the positioning of the sub-cranial component 204B underneath the opening, the lead wire 228B (i.e., the conductor 246B and the casing 248B) comprises a bend 256 adjacent to the location at which the lead wire 228B connects to the sub-cranial component 204B. The bend 246B may be an approximately ninety (90) degree bend that is pre-formed in the lead wire 228B. A pre-formed bend 246B, rather than a bend formed by a surgeon during the surgical process, may have the advantage that the bend serves to anchor the sub-cranial component 204B in position.

As noted above, a sub-cranial component of a sub-cranial vibratory stimulator in accordance with embodiments presented herein is configured to be positioned between a recipient's skull and the recipient's dura mater. The dura mater is a thick membrane forming the outermost of three layers that surround the brain and is responsible for retaining the CSF. In general, if a sub-cranial component has too great of a thickness, then the sub-cranial component may significantly displace the dura mater in a manner that places a continuous force on the recipient's brain. A continuous force on the recipient's brain could change the brain shape that may result in a functional or cognitive change in the brain. As such, a feature of the sub-cranial component in accordance with embodiments presented herein is that the sub-cranial component is relatively thin so as to cause minimal displacement of dura mater and, accordingly, to have little or no long term effects on the brain shape. In general, the sub-cranial component has a thickness that is less than approximately five (5) millimeters (mm) deep. The width and/or length of the sub-cranial component may be substantially greater than 5 mm.

Figure 3A:
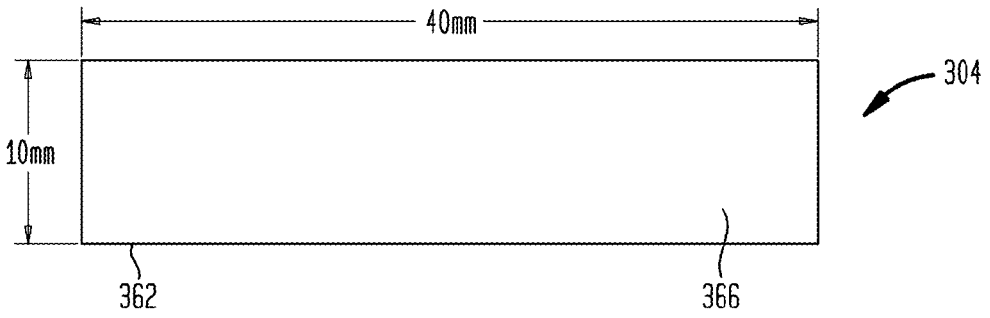
FIG. 3A is a top view of a sub-cranial component in accordance with embodiments presented herein.
Figure 3B:
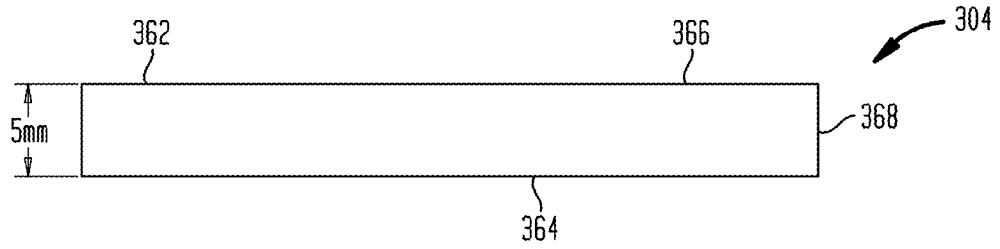
FIG. 3B is a side view of the sub-cranial component of FIG. 3A.
Figure 3C:
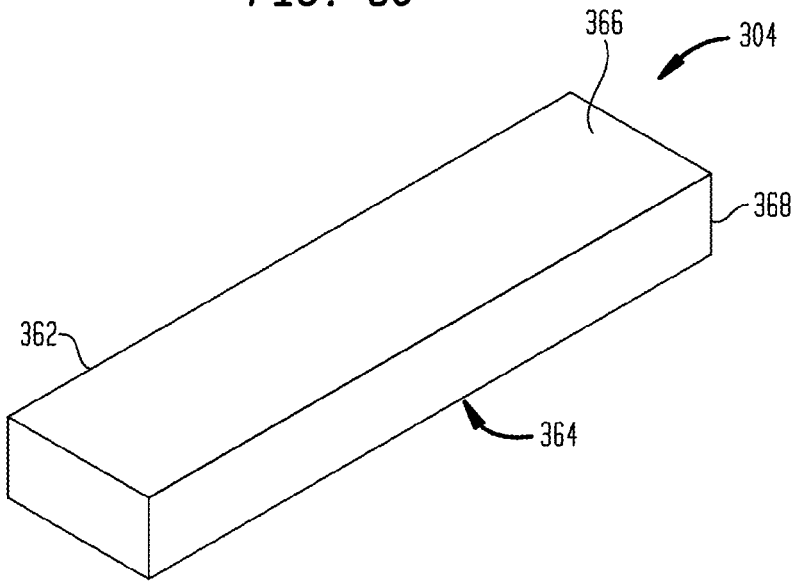
FIG. 3C is a perspective view of the sub-cranial component of FIG. 3A.

FIGS. 3A, 3B, and 3C are top, side, and perspective views, respectively, of a sub-cranial component 304 in accordance with embodiments of the present invention. In the embodiment of FIGS. 3A-3C, the sub-cranial component 304 comprises a body 362 formed by a first (bottom) surface 364, a second (top) surface 366, and a lateral (side) surface/wall 368 connecting the bottom surface 364 to the top surface 366. As used herein, a "bottom" surface refers to a surface of the sub-cranial component 304 that is configured to be implanted facing a recipient's dura mater, while a "top" surface refers to a surface configured to be implanted facing a recipient's skull bone.

The body 362 has a generally rectangular shape where the lateral surface 318 generally has four sides connected by rounded corners. Positioned in the body 362 is an actuator (not shown in FIGS. 3A-3C) that is configured to vibrate a recipient's bodily fluid. The body 362 is formed from a vibration damping material and operates as an isolation member.

In the illustrative embodiments of FIGS. 3A-3C, the width and length of the sub-cranial component 304 are substantially greater than the thickness (depth) of the sub-cranial component 304. More specifically, the sub-cranial component 304 has a thickness of approximately five (5) mm, a width of approximately ten (10) mm, and a length of approximately forty (40) mm. As such, the width and length of the sub-cranial component 304 are several times larger than the thickness of the sub-cranial component 304 (i.e., a width that is twice the thickness and a length that is eight (8) times the thickness).

In the embodiment of FIGS. 3A-3C, a lead wire (not shown in FIGS. 3A-3C) connects to the actuator within the body 362 through a short edge of lateral wall 368. That is, the lead wire connects or, or extends through, a shorter edge (i.e., a 10 mm edge) of lateral wall 368.

It is to be appreciated that the dimensions of the sub-cranial component 304 of FIGS. 3A-3C are illustrative and that other dimensions are possible. The dimensions of the sub-cranial component 304 may depend on a number of different factors, including the type and/or operation of the actuator, the vibration damping properties of the body 312, etc.

Figure 4A:
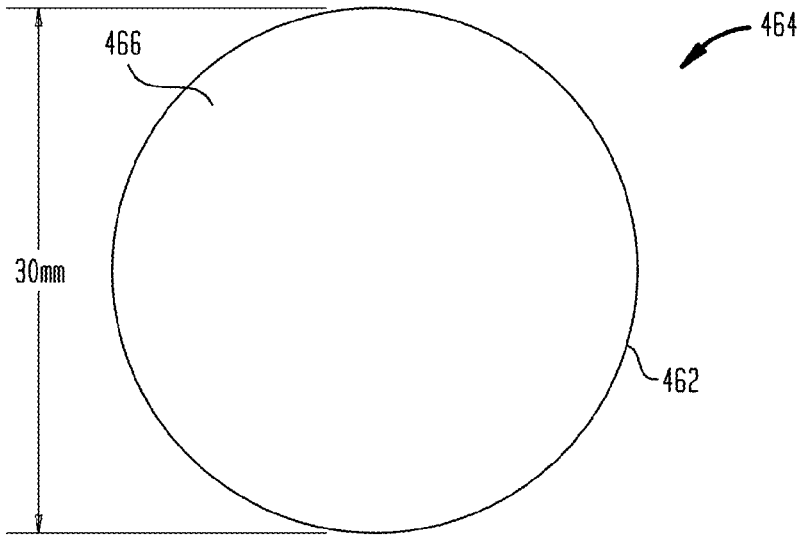
FIG. 4A is a top view of a sub-cranial component in accordance with embodiments presented herein.
Figure 4B:
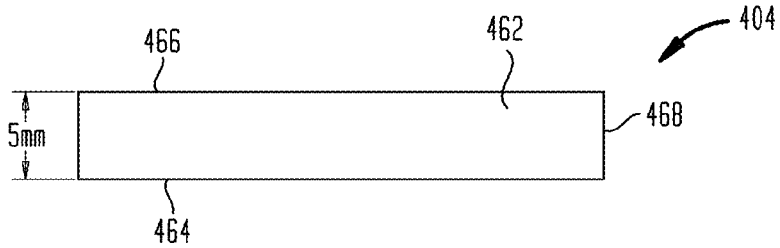
FIG. 4B is a side view of the sub-cranial component of FIG. 4A.
Figure 4C:
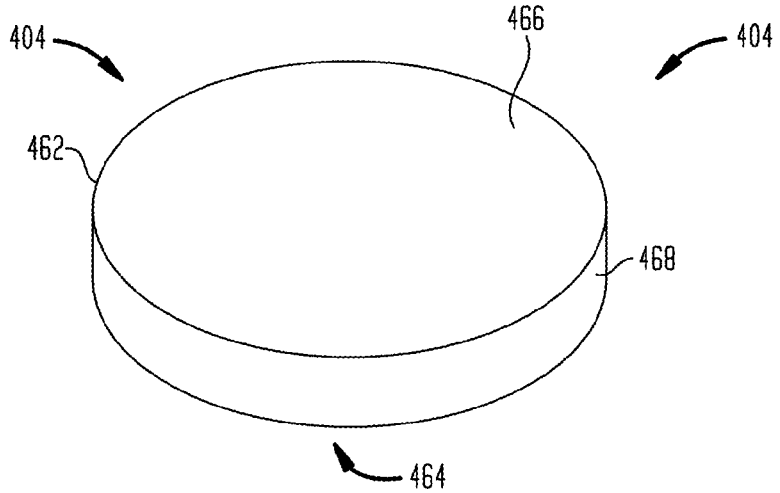
FIG. 4C is a perspective view of the sub-cranial component of FIG. 4A.

FIGS. 4A, 4B, and 4C are top, side, and perspective views, respectively, of a sub-cranial component 404 in accordance with embodiments of the present invention. In the embodiment of FIGS. 4A-4C, the sub-cranial component 404 comprises a body 462 formed by a bottom surface 464, a top surface 466, and a lateral surface/wall 468 connecting the bottom surface 464 to the top surface 466.

The body 462 has a generally cylindrical or disk (i.e., a flattened-circular) shape. Positioned in the body 462 is an actuator (not shown in FIGS. 4A-4C) that is configured to vibrate a recipient's bodily fluid. The body 462 is formed from a vibration damping material and operates as an isolation member.

In the illustrative embodiments of FIGS. 4A-4C, the diameter of the sub-cranial component 404 is substantially greater than the thickness (depth) of the sub-cranial component 404. More specifically, the sub-cranial component 304 has a thickness of approximately four (4) mm and a diameter of approximately thirty (30) mm. As such, the diameter of the sub-cranial component 404 is several times larger than the thickness of the sub-cranial component 404 (i.e., the diameter is over seven (7) times the thickness).

In the embodiment of FIGS. 4A-4C, a lead wire (not shown in FIGS. 4A-4C) connects to the actuator within the body 462 through lateral wall 468. That is, the lead wire connects or, or extends through, lateral wall 468.

It is to be appreciated that the dimensions of the sub-cranial component 404 of FIGS. 4A-4C are illustrative and that other dimensions are possible. The dimensions of the sub-cranial component 404 may depend on a number of different factors, including the type and/or operation of the actuator, the vibration damping properties of the body 412, etc.

It is to be appreciated that the shapes of bodies 362 and 462 shown in FIGS. 3A-3C and 4A-4C, respectively, are illustrative and that other shapes may be used in alternative embodiments.

Figure 5:
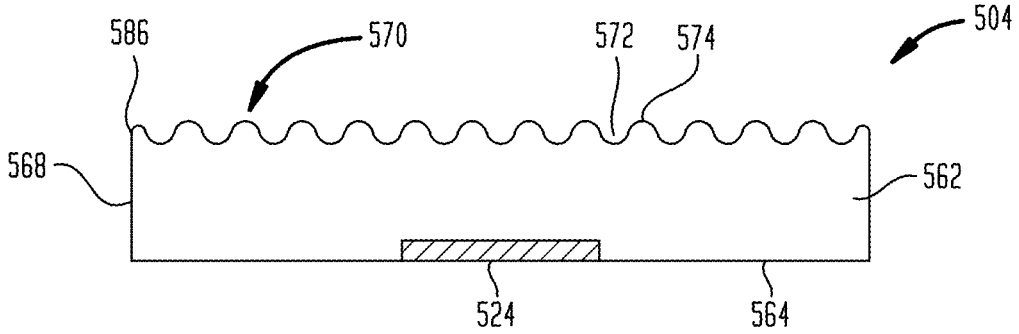
FIG. 5 is a cross-sectional view of a sub-cranial component in accordance with embodiments presented herein.

In general, a body of a sub-cranial component in accordance with embodiments presented herein is configured to provide feedback isolation and provides a top surface area that operates with a recipient's skull bone to retain the sub-cranial component in an implanted position. More specifically, in accordance with certain embodiments presented herein, sub-cranial components are implanted in the recipient and are not secured to the recipient's skull bone. Instead, the large surface area of the top surface interacts with the bottom surface of the recipient's skull bone (possibly via force applied by the dura mater) to retain an implanted position. In certain embodiments, the top surface of a sub-cranial component may include one or more surface features that are configured to enhance the interaction (e.g., friction, integration, etc.) between the top surface of the sub-cranial component and recipient's skull. FIG. 5 is a cross-sectional view of a sub-cranial component in accordance with such embodiments.

FIG. 5 illustrates a sub-cranial component 504 that comprises body 562 formed by a bottom surface 564, a top surface 566, and a lateral surface 568 collectively forming a generally rectangular shape. Positioned in the body 562 at the bottom surface 564 is an actuator 524 that is configured to vibrate a recipient's bodily fluid. The body 562 is formed from a vibration damping material and operates as an isolation member.

The top surface 566 includes surface features 570 in the form of a plurality of recesses in the top surface 566. The recesses 570 include a plurality of spaced grooves or troughs 572 separated by ridges 574. The grooves 572 are, in this embodiment, elongate concave grooves having a radius of curvature and extending substantially across the surface 566. Similarly, the ridges 574 are, in this embodiment, elongate convex ridges having a radius of curvature and extend substantially across the surface 566. In general, the grooves 572 and ridges 574 function to increase the surface area of the surface 666 (relative to a planar surface) so as to increase the interaction between the sub-cranial component 504 and the recipient's skull bone. The grooves 572 and/or ridges 574 may have cross-sectional shapes that are rectangular, triangular, trapezoidal, L-shaped, T-shaped, J-shaped, dovetailed, frustoconical, etc.

It is to be appreciated that the surface features of FIG. 5 are illustrative and other surface features may be used in alternative embodiments. For example, the surface features may be formed by protrusions, rather than recesses. In such embodiments, the protrusions may be a generally parabolic or dome shaped, square, rectangular, arcuate, etc. and are positioned across the top surface.

Figure 6A:
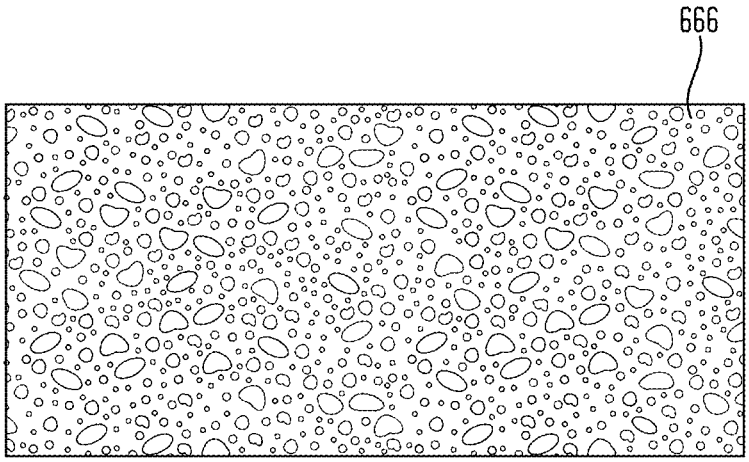
FIG. 6A is a top view of a sub-cranial component in accordance with embodiments presented herein.
Figure 6B:
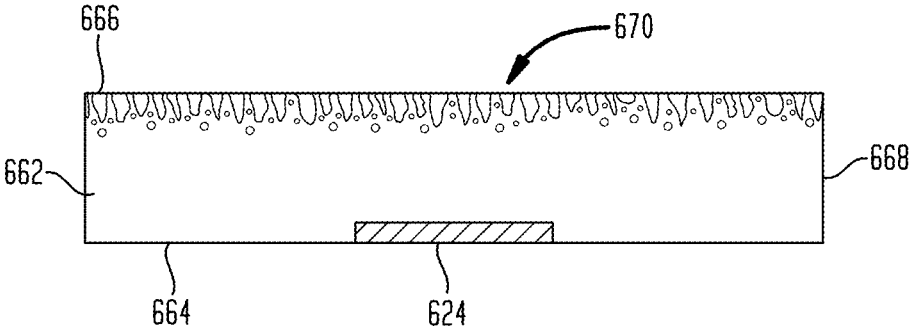
FIG. 6B is a cross-sectional view of the sub-cranial component of FIG. 6A.

FIGS. 6A and 6B are top and cross-sectional views, respectively, of another sub-cranial component 604 that includes surface features at the top surface. The sub-cranial component 604 comprises body 662 formed by a bottom surface 664, a top surface 666, and a lateral surface 668 collectively forming a generally rectangular shape. Positioned in the body 662 at the bottom surface 664 is an actuator 624 that is configured to vibrate a recipient's bodily fluid. The body 662 is formed from a vibration damping material and operates as an isolation member.

The top surface 666 includes surface features 670 in the form of a plurality of pores in the top surface 666. The pores 670 may have irregular shapes configured to encourage osteoconduction and/or osseointegration of the recipient's skull with the top surface 666. Osteoconduction and/or osseointegraton may create an interlock between the top surface 666 and the recipient's skull bone so as to maintain the sub-cranial component 604 in an implanted position.

FIGS. 5, 6A, and 6B illustrate embodiments in which surface features at a top surface of a sub-cranial component assist in retaining the sub-cranial component in an implanted position. It is to be appreciated that other mechanisms may be used to retain the cranial component in an implanted position.

For example, in certain embodiments screws or other fasteners may be used to secure the sub-cranial component to the recipient's skull bone. In such embodiments, the body of the sub-cranial component may include apertures configured to receive fasteners. Alternatively, the sub-cranial component may include one or more fastening members that extend from the body of the sub-cranial component that may be secured to the skull bone with a fastener. In one such embodiment, a fastening member has a length that can extend from the sub-cranial component through the opening in the recipient's skull for securement to an outer surface of the skull via, for example, a bone screw. Such fastening members may be formed from the same material as the body.

In embodiments in which fasteners are used to secure the sub-cranial component to the skull bone, the body operates to prevent the fasteners from providing a pathway for vibrations to the skull. In other words, in embodiments that use fasteners, the body still operates as an isolation member that substantially mechanical decouples the actuator from the skull bone.

Figure 7:
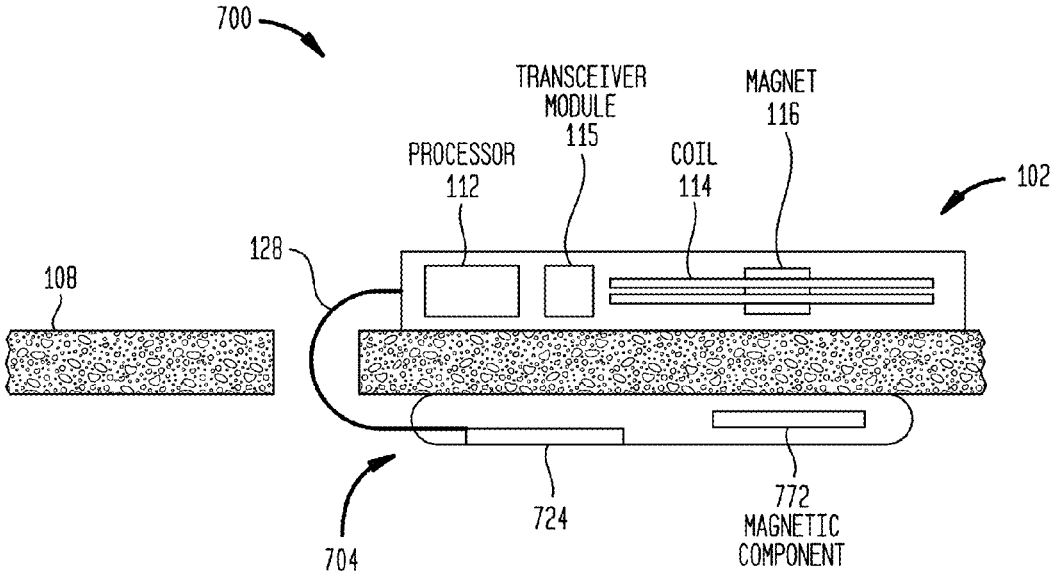
FIG. 7 is a cross-sectional schematic diagram illustrating a sub-cranial vibratory stimulator in accordance with embodiments presented herein.

FIG. 7 is a cross-sectional view of another mechanism that may be used to secure a sub-cranial component 704 to a recipient. More specifically, in the embodiment of FIG. 7 a magnetic component is used to retain the sub-cranial component 704 in an implanted position. The sub-cranial component 704 of FIG. 7 is part of a sub-cranial vibratory stimulator 700 that includes an electronics module 102 as described above with reference to FIG. 1A.

In the embodiment of FIG. 7, sub-cranial component 704 includes a body 762 formed from a vibration damping material that operates as an isolation member. Positioned in the body 762 are an actuator 724 and a magnetic component 772. Magnetic component 772 may be a permanent magnet or include magnetic material that generates and/or is reactive to a magnetic field. As shown, the sub-cranial component 704 may be positioned in an implanted position that is substantially beneath the electronics module 102. That is, the sub-cranial component 704 is separated from the electronics module 102 by recipient's skull bone 108. In this position, the magnetic component 772 may be magnetically coupled to the magnet 116 in the electronics module 102 so as to retain the sub-cranial component 704 in an implanted position.

Figure 8A:
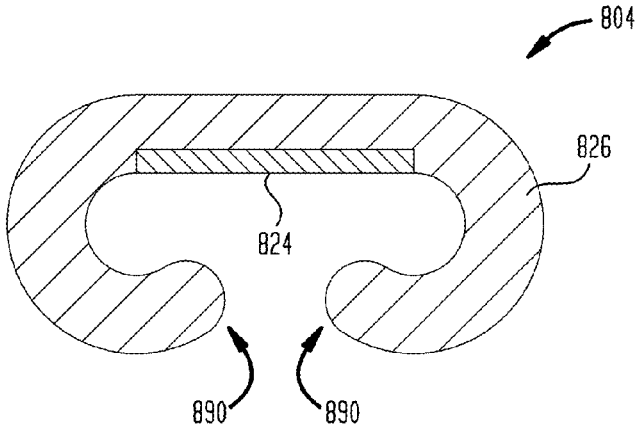
FIG. 8A is a cross-sectional view of an expandable sub-cranial component in accordance with embodiments presented herein shown in a compact configuration.
Figure 8B:
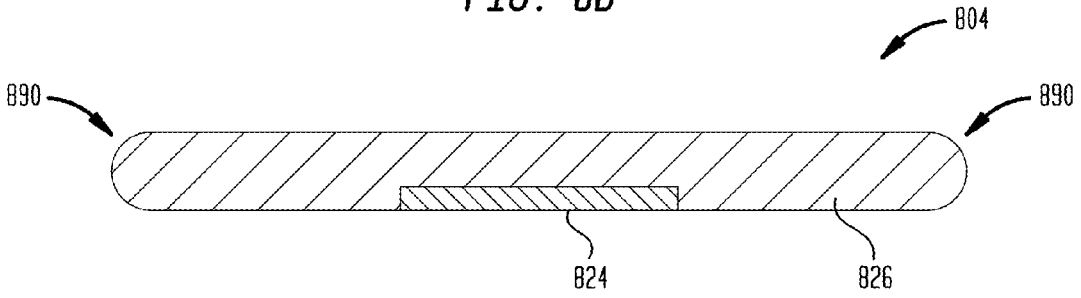
FIG. 8B is a cross-sectional view of the expandable sub-cranial component of FIG. 8A shown in an expanded configuration.

FIGS. 8A and 8B are cross-sectional views of an expandable sub-cranial component 804 in accordance with embodiments presented. FIG. 8A illustrates the expandable sub-cranial component 804 in a first (compressed) configuration, while FIG. 8B illustrates the expandable sub-cranial component 804 in a second (expanded) configuration.

The sub-cranial component 804 comprises an actuator 824 positioned in a body 826. The body 826 is formed from a vibration damping material and operates as an isolation member. Additionally, the material used to form body 826, or at least portions 890 of the body 826, is a flexible material that may be folded, bent, or otherwise manipulated into a compressed configuration to enable insertion through an opening in a recipient's skull bone. In the embodiment of FIG. 8A, the portions 890 of the body 826 are configured to be folded in order to compress the size of the sub-cranial component 804.

After the sub-cranial component 804 is inserted through an opening in the recipient's skull, the sub-cranial component 804 is configured to adopt the expanded configuration shown in FIG. 8B. In one specific example, the body 826 (or at least the portions 890) is formed from a memory material that is pre-formed into the expanded configuration. In such embodiments, the portions 890 may be held in the compressed configuration during insertion through the opening, and then released to return to the pre-formed expanded configuration.

Figure 9A:
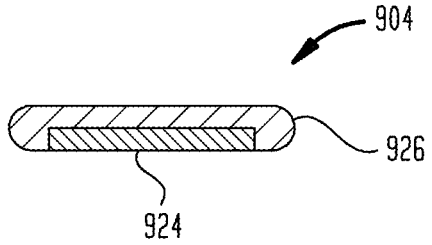
FIG. 9A is a cross-sectional view of an expandable sub-cranial component in accordance with embodiments presented herein shown in a compact configuration.
Figure 9B:
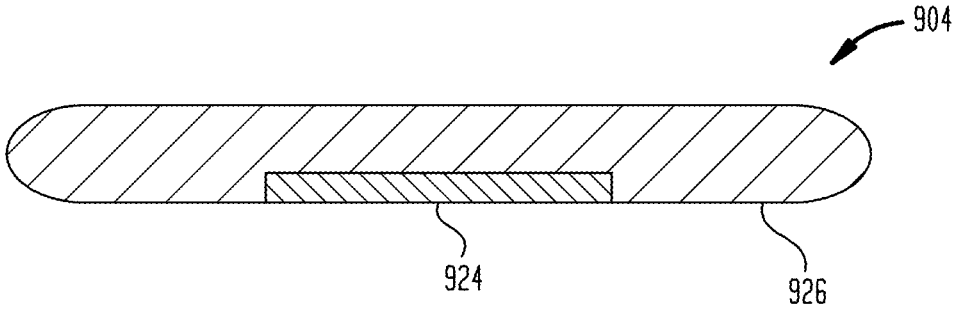
FIG. 9B is a cross-sectional view of the expandable sub-cranial component of FIG. 9A shown in an expanded configuration.

FIGS. 9A and 9B are cross-sectional views of an expandable sub-cranial component 904 in accordance with embodiments presented. FIG. 9A illustrates the expandable sub-cranial component 904 in a first (compressed) configuration, while FIG. 9B illustrates the expandable sub-cranial component 904 in a second (expanded) configuration.

The sub-cranial component 904 comprises an actuator 924 positioned in a body 926. The body 926 is formed from a vibration damping material and operates as an isolation member. Additionally, the material used to form body 926, or portions thereof, is configured to expand (swell) when exposed to a recipient's bodily fluid. More specifically, after the sub-cranial component 904 is inserted through an opening in the recipient's skull, the sub-body 826 swells to the expanded configuration shown in FIG. 9B.

A sub-cranial vibratory stimulator in accordance with embodiments presented herein comprises an actuator configured to vibrate fluid within a recipient's skull directly (i.e., without first vibrating the recipient's skull bone). The use of an actuator that at least partially bypasses a recipient's skull bone may lower the power needed and enables a range of previously unavailable low-power actuators to be used to treat hearing loss. In general, the actuator is part of a sub-cranial component that is non-bone fixated or has limited bone fixation, thereby reducing or eliminating feedback pathways that may pose problem with bone anchored devices. The positioning of the actuator beneath a recipient's skull provides protection from external forces, thereby enabling the use of previously unavailable fragile material to be used as part of the sub-cranial component. Finally, in certain circumstances a sub-cranial vibratory stimulator may be activated (i.e., turned on after surgical implantation) faster than traditional bone conduction devices as there may be no or limited need for osseointegration.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. An apparatus, comprising:

an implantable actuator configured to be implanted between a recipient's skull bone and the recipient's dura mater to vibrate bodily fluid of the recipient; and an isolation member formed from a vibration damping material configured to be positioned between the implantable actuator and the recipient's skull bone and configured to substantially mechanically decouple the implantable actuator from the recipient's skull bone, wherein the implantable actuator and isolation member are configured to be implanted through an opening in the recipient's skull bone, and wherein the isolation member is configured to have a first compressed configuration to enable insertion through the opening and a second expanded configuration after insertion through the opening.

2. The apparatus of claim 1, wherein the implantable actuator is a low-power actuator having a maximum power requirement of less than approximately 1 milliwatts (mW).

3. The apparatus of claim 1, wherein the implantable actuator is a piezoelectric actuator.

4. The apparatus of claim 1, wherein the isolation member comprises a silicon member.

5. The apparatus of claim 1, wherein the isolation member and the implantable actuator are configured to retain a selected implantable position between the recipient's skull bone and the dura mater without the addition of fixation elements.

6. The apparatus of claim 5, wherein a surface of the isolation member is configured to abut the recipient's skull bone and includes one or more surface features configured to facilitate securement of the isolation member to the recipient's skull bone.

7. The apparatus of claim 1, wherein the isolation member is formed from a flexible material configured to be one or more of rolled or folded into the first compressed configuration to enable insertion through the opening.

8. The apparatus of claim 1, further comprising:

a radio-frequency (RF) coil configured to receive RF signals from an external device and configured to be positioned at an outer surface of the recipient's skull bone; and a processor configured to generate actuator drive signals based on the RF signals for delivery to the actuator, wherein the processor is positioned in the isolation member.

9. The apparatus of claim 1, further comprising:

an RF coil configured to receive RF signals from an external device and configured to be positioned at an outer surface of the recipient's skull bone; and a processor configured to generate actuator drive signals based on the RF signals for delivery to the actuator, wherein the processor is configured to be implanted at an outer surface of the recipient's skull bone.

10. The apparatus of claim 1, wherein the apparatus is a sub-cranial vibratory stimulator configured to enable the recipient to perceive a frequency range of sounds through the use of only the implantable actuator.

11. A sub-cranial component, comprising:

a body formed from a vibration damping material configured to be implanted between a recipient's skull bone and the recipient's dura mater;

an implantable actuator positioned in the body and configured to generate mechanical vibrations for delivery to bodily fluid of the recipient, wherein the body is configured to substantially mechanically decouple the actuator from the recipient's skull bone to substantially prevent mechanical vibrations generated by the implantable actuator from passing through the body to the skull bone, wherein the actuator and the body are configured to be implanted through an opening in the recipient's skull bone, and wherein the body is configured to have a first compressed configuration to enable insertion through the opening and a second expanded configuration after insertion through the opening.

12. The sub-cranial component of claim 11, wherein the body has a generally rectangular shape.

13. The sub-cranial component of claim 12, wherein the body has a thickness of less than approximately 5 millimeters (mm), a width that is substantially greater than 5 mm, and a length that is substantially greater than 5 mm.

14. The sub-cranial component of claim 12, wherein the body has a width of approximately 10 mm and a length of approximately 40 mm.

15. The sub-cranial component of claim 11, wherein the body has a generally cylindrical shape.

16. The sub-cranial component of claim 15, wherein the body has a thickness of less than approximately 5 millimeters (mm) and a diameter that is substantially greater than 5 mm.

17. The sub-cranial component of claim 15, wherein the body has a diameter of approximately 30 mm.

18. The sub-cranial component of claim 11, wherein the implantable actuator is a low-power actuator.

19. The sub-cranial component of claim 18, wherein the implantable actuator is a piezoelectric actuator.

20. The sub-cranial component of claim 11, wherein the body comprises a silicon member.

21. The sub-cranial component of claim 11, wherein the body is configured to retain a selected implantable position between the recipient's skull bone and the dura mater without the addition of fixation elements.

22. The sub-cranial component of claim 21, wherein a surface of the body is configured to abut the recipient's skull bone and includes one or more surface features configured to facilitate securement of the body to the recipient's skull bone.

23. The sub-cranial component of claim 11, wherein the body is formed from a flexible material configured to be one or more of rolled or folded into the first compressed configuration to enable insertion through the opening.

24. An apparatus, comprising:

an implantable actuator configured to be implanted between a recipient's skull bone and the recipient's dura mater to vibrate bodily fluid of the recipient; and an isolation member formed from a vibration damping material configured to be positioned between the implantable actuator and the recipient's skull bone and configured to substantially mechanically decouple the implantable actuator from the recipient's skull bone, wherein the implantable actuator and isolation member are configured to be implanted through an opening in the recipient's skull bone, and wherein the isolation member is formed from a flexible material that can be folded, bent, or otherwise manipulated into a compressed configuration to enable insertion through the opening.

* * * * *